United States Patent [19]

Iannazzi

[11] 4,127,476

[45] Nov. 28, 1978

[54] AIR-CLASSIFICATION APPARATUS AND PROCESS FOR THE SEGREGATION OF MIXED OFFICE-PAPER WASTE

[75] Inventor: Fred D. Iannazzi, 45 Oriole Dr., Andover, Mass. 01810

[73] Assignees: Fred D. Iannazzi, Andover; Richard P. Crowley, Wellesley, both of Mass.

[21] Appl. No.: 805,967

[22] Filed: Jun. 13, 1977

[51] Int. Cl.[2] ..... B03B 4/00

[52] U.S. Cl. ..... 209/3; 209/138; 209/474; 209/490

[58] Field of Search ..... 209/134–139 R, 209/140, 141, 474–476, 471, 472, 490, 492, 3

[56] References Cited

U.S. PATENT DOCUMENTS

| | | | |
|---|---|---|---|
| 1,250,553 | 12/1917 | Bryan | 209/139 R |
| 2,683,685 | 7/1954 | Matheson | 209/138 X |
| 2,899,139 | 8/1959 | Hardinge | 209/138 X |
| 3,738,483 | 6/1973 | MacKenzie | 209/137 X |
| 3,865,241 | 2/1975 | Crow | 209/492 X |

FOREIGN PATENT DOCUMENTS

| | | | |
|---|---|---|---|
| 2,542,571 | 3/1977 | Fed. Rep. of Germany | 209/137 |

*Primary Examiner*—Frank W. Lutter
*Assistant Examiner*—Ralph J. Hill
*Attorney, Agent, or Firm*—Richard P. Crowley

[57] ABSTRACT

A process and system for the segregation and separation of mixed office-paper-waste material which comprises: shredding the waste material to a uniform size; forming a fluidized bed of the shredded waste material in a vertical column by an upwardly flowing, high-volume, low-pressure air stream, to divide the material into distinct layers in the column; and separating and removing the layers from the column with lateral airflow.

10 Claims, 2 Drawing Figures

AIR-CLASSIFICATION APPARATUS AND PROCESS FOR THE SEGREGATION OF MIXED OFFICE-PAPER WASTE

BACKGROUND OF THE INVENTION

Air-classification systems for the separation of solid waste materials are well known. Such systems typically separate waste materials according to density and shape in a gross-type separation process, whereby very heavy materials; for example, stones, glass and metals, medium heavy materials like plastics, cardboard and paper and wood and paper products, and very lightweight materials like dirt, dirt particles, light paper, etc. are separated. The mixed material is dropped into a vertically rising or even a zigzag-type column with a rising airflow, whereby gross segregation of heavy, medium and light fractions occurs.

Although such systems often are useful and desirable, the economic value of the systems is limited, since only gross types of segregation occur, and the segregated waste often has limited economic value, while also comprising a mixture of similar-density, but differently composed and valued, material. Vertical air-classification systems, for example, are described in U.S. Pat. Nos. 3,907,670 and 3,986,949, while horizontal air-classification systems are represented by U.S. Pat. No. 1,290,895.

One unique type of solid waste material is mixed office-paper waste generally named for and derived from waste materials from administrative or office operations in comparison to industrial, municipal or household solid waste material. Mixed office waste has a low economic value and limited commercial utility. Typically, the office-paper waste comprises principally printing and writing paper of greater commercial utility, and hence greater value. However, materials in the waste, such as small amounts; for example, up to 15% by weight, such as 2 to 10%, of other low-grade paper-like materials, such as coffee cups, recycled board, corrugated boxes and small amounts of contaminants, mainly carbon paper, plastic film, glassine paper, hot-melt adhesives, etc., diminish substantially the value and utility of the mixed office-waste material. Thus, there exists a need for the efficient, simple and economical segregation of the components of mixed office-paper waste which will permit the recovery of the more economically valuable components therein.

SUMMARY OF THE INVENTION

My invention relates to a system for and a process of segregating mixed waste material. In particular, my invention concerns an air-classification system for and a process of segregating mixed office-paper waste and the recovery of the more valuable components thereof and to the constituent mixture so recovered.

My invention is directed to the employment of a vertical air-classification fractionating apparatus and process to effect the removal of contaminants and low-valued paper material from mixed office-paper waste. My invention concerns the formation, in a vertically upward, flowing-air column, of discrete and distinct layers of preshredded office-paper waste and the removal of the distinctly air-clasified material from the layers by lateral movement of the material in the layers out of the air-classifying column. My system and process permit the segregation and collection of office-paper waste, so that the more economically valuable material may be recovered.

In one embodiment, my air-classification system permits the segregation of typical office waste into three layers. The top layer comprises low-basis-weight, one-time-carbonizing tissue and plastic film, a middle layer of writing, bond and newsprint paper, and a lower layer of high-basis-weight materials, such as coffee cups, corrugated board and board stock. When the office waste is segregated by air suspension into distinct layers, the various grades and layers can be separated one from the other. If desired, the segregated and recovered materials may be segregated further and classified into even finer-grade distinctions by preprocessing in another air-classifying column of my invention, particularly where the recovered waste material is shredded again to a finer particle size prior to further reclassification.

Separation of the segregated layers in my system is effected by inducing lateral flow of the shredded material in each layer to one or more collection or recovery conduits positioned adjacent the fluidized layer in the air-fractionating column. Lateral movement, while the shredded material is in distinct fluidized layers, is accomplished by the use of a vacuum or air-flow at low volume and high pressures to induce lateral movement of the shredded material into the separation duct. The separation can occur continuously during the air-classification process when a stady-state condition of layer formation is achieved, or periodically as a batch process.

My system and process comprises in general: the preshredding of the mixed office-paper waste into substantially uniform and finely-divided particle sizes; for example, uniform size of not greater than about 8½ inches or less; for example, 2½ inches, with smaller-size reductions permitting better classification; introducing the uniformly preshredded, mixed material into a vertical air-classifying or -fractionating column typically into the lower portion, such as the bottom, of the column; passing high-volume, low-pressure air upwardly through the column to form a fluidized bed of the shredded material, with the formation of discrete fluidized layers of the segregated material formed throughout the column; and removing continually or periodically the material in each discrete fluidized layer by lateral flow of the material from the discrete layer, such as by the use of a vacuum adjacent the layer or by high-pressure, low-volume air passed laterally through the discrete layer. It is desirable often to create an eductor effect (high-velocity low pressure) at each discharge conduit to sweep the segregated material from the discrete layer in the column to the separation conduit.

It is important to the formation of discrete fluidized-bed layers that the mixed office-paper waste material be shredded or reduced otherwise in size to an essentially uniform particle size. Uniformity in size is more desirable in effecting distinct fluidized layers of material. The size of the waste material may vary, depending on the mixture of the waste material to be separated, but typically is less than 8½ inches and ranges from ½ to 4 inches in size. Reduction in size, hereinafter called shredding, may be effected in a number of ways, such as by cutting- or milling-type equipment like a hammer mill, rotary cutters or similar equipment or other means. After initial segregation and separation, even better classification may be accomplished by further air-classifying in similar fractionating columns to effect a finer separation of each grade. For example, my invention permits often the removal of 60 to 80% by weight of the contaminants in the waste at the top layer, which permits recovery of the more valuable bond paper, writing paper and newsprint at the lower layer, while the heavier coffee cups and cardboard occur as bottoms on the air-fractionating column. The recovered mixture of printing, writing and newsprint paper can be reprocessed in a separate air-fractionating column, with or without additional size reduction, to effect a better and more discrete segregation and separation of the constituent grades of paper materials therein.

My invention will be described for the purpose of illustration only in connection with its preferred embodiment. However, it is recognized that changes and modifications, within the skill of those persons skilled in the art, may be made in my system and process without departing from the spirit and scope thereof.

DESCRIPTION OF THE PREFERRED EMBODIMENTS

Figure 1:
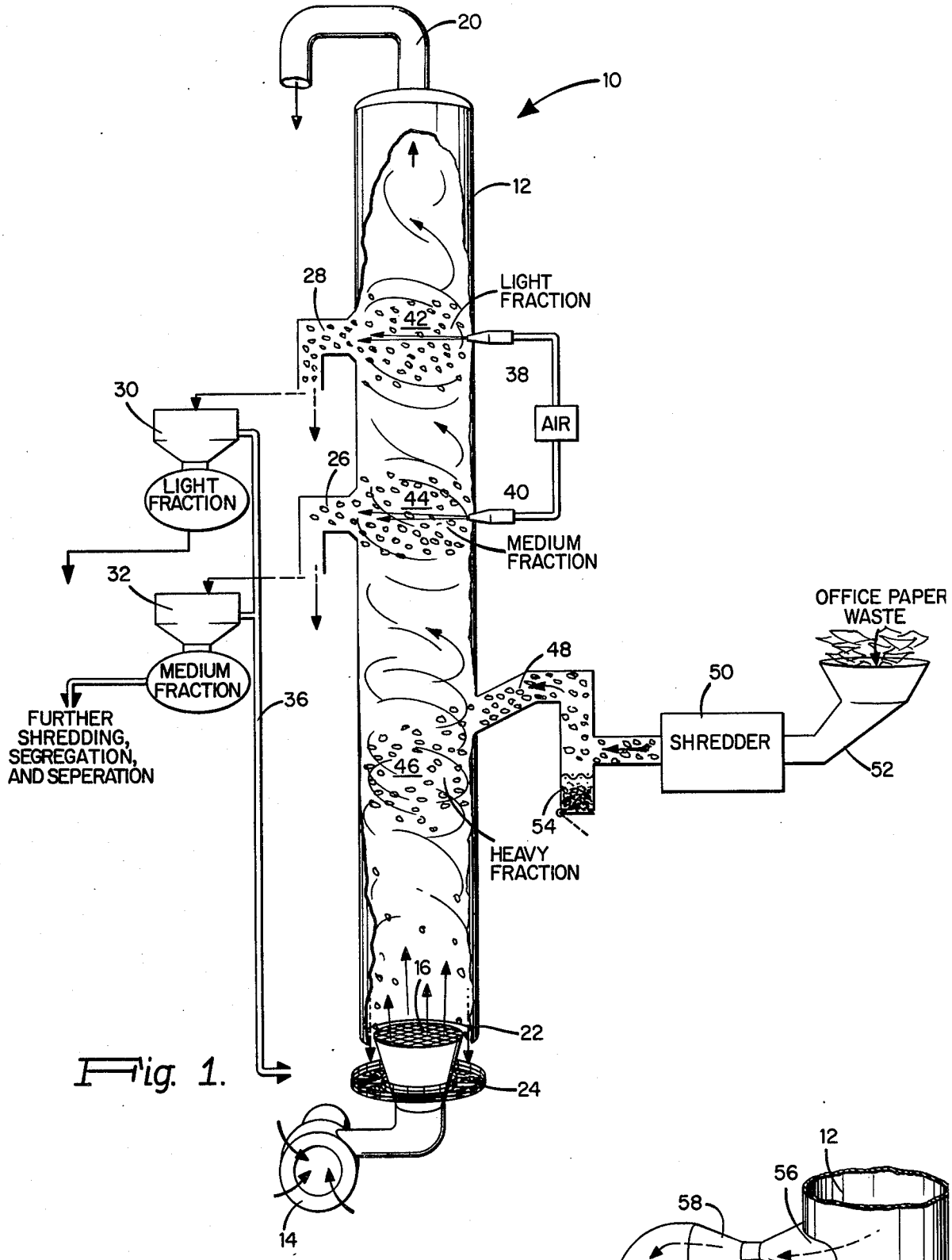
FIG. 1 is a representative, schematic, partially sectional illustration of the air-classification system for office-paper waste of my invention.

My air-classification system 10 comprises a vertically disposed fractionating column 12 through which air is passed upwardly therein by a high-volume, low-air-pressure blower 14 through screen 16 and plenum chamber 18. Air is exhausted from the column 12 through top-exhaust duct 20. The column includes a bottom-discharge outlet 22, with a collection screen 24 for the discharge and collection of heavy fractions. Light-fraction 28 and medium-fraction 26 discharge ducts or collection spouts are provided at prepositioned intervals in the column, which ducts are in communication with waste-recovery cyclones 30 and 32 with air-recycle line 36 connected from the cyclones to the blower 14 for recycling air.

Opposite the ducts 26 and 28 are positioned high-pressure, low-volume, air-jet nozzles 40 and 38. The air-classified, fluidized, discrete layers of waste material in the column 12 are shown as light 42, medium 44 and heavy 46 fractions which make up the office-paper waste to be segregated and separated. The system includes an inlet 52 for the introduction of mixed office-paper waste, a shredder 50 to provide uniform waste particles, prescreening of the waste optional, a trap 54 for the collection and periodic removal of heavy contaminants, and a tapered column inlet 48 for the introduction of the shredded waste material into the bottom portion of the column 12.

Figure 2:
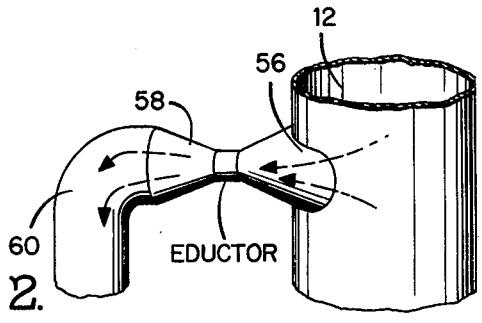
FIG. 2 is a representative illustration of another embodiment for separation of the segregated waste material in the system of FIG. 1.

FIG. 2 illustrates another embodiment for the lateral movement of the segregated, shredded waste material from the column 12 through discharge outlet 56 by means of a converging-diverging air-jet eductor supplied with high-pressure air to induce a vacuum to permit the withdrawal of waste through the eductor 58 to the discharge conduit 60; hence to recovery or collection.

In operation, mixed office-paper waste; for example, 0 to 10% light contaminants, 0 to 10% heavy office materials, and the remainder writing and newsprint papers and similar paper materials, is introduced into inlet 52, and is preshredded in shredder 50 to a uniform particle size; for example, about $\frac{1}{4} \times 2$ inches by $\frac{1}{4} \times 2$ inches, and heavy fall-out material, after shredding, is collected and removed via trap 54 with an insulation screen and a removable lower trap door. The uniformly shredded waste material is introduced via 48 into column 12, wherein there is an upward airflow by virtue of air blower 14; for example, at a low pressure of about 5 to 40 psig, with an air volume of 40 to 60 cubic feet per minute used per pound of shredded waste material. In the lower portion of the column 12 above the screen 16 and the plenum chamber, fluidization and segregation of the shredded waste material occur, because of the dissimilarity of weight per area density and shape of the materials. The heavy fraction, unable to be fluidized, falls and is discharged at the bottom discharge 22 and is collected by collection screen 24 adjacent the opening 22.

The high volume of vertical airflow moving upwardly rapidly fluidizes the waste material; for example, into discrete, separate, fluidized-bed layers typically shown generally as a heavy fraction 46, a medium fraction 44 and a light fraction 42; although, of course, the number of discrete layers may vary and may be greater in number than illustrated. The waste material is introduced preferably into the bottom of the column to avoid disturbing the previously classified material; that is, to permit the material to be classified by upward flow. Air exhausted from the column 12 through exhaust duct 20 may be recycled to the main blower 14 for recycle and reuse.

After segregation in the fluidized bed, the light 42 and medium 44 layers; for example, writing and newsprint paper, are separated and removed from the column 12 by a blast of high-pressure, low-volume air from jets 38 and 40; for example, at a pressure of 40 to 120 psig. The fluidized material in the layers moves into the adjacent discharge ducts 26 and 28. The air jets may be used periodically or continuously, depending upon the amount of waste material in the layers and times of removal desired. From the collection ducts 26 and 28, the separated material is recovered in a solid-gas separator, such as air cyclones 30 and 32, and is recovered for use or further classification or for recovery. Often it is desirable to preshred the medium-waste fraction and again segregate and separate to achieve fine separation of the various paper materials.

In the embodiment of FIG. 2, an eductor 58 is used to remove waste material by vacuum to the discharge conduit 50. Of course, my system has been described in one simple embodiment, and the number and position of the dischrage ducts and jets and eductors and the number of layers may vary, depending on the waste material.

The segregation of mixed office-waste paper was demonstrated by the formation of a composition, the cutting of the waste material by a paper cutter into $\frac{1}{2}$-inch uniform pieces and the placing of the material in a Waring Blender, wherein the lower rotating blade formed a column of vertical air and the waste material was segregated. Table I shows the segregation of a waste-paper composition by my air-classification system.

TABLE I

COMPOSITION OF SEGREGATED WASTE-PAPER FRACTIONS

Basis: Composition of "office waste" feed material:
5% carbon paper
5% Hot Melt - coated coffee cups
90% Bond/News

| Point of Collection | Carbon Paper | | Bond/News | | Hot-Melt Coated | | Total |
|---|---|---|---|---|---|---|---|
| | Amount Discharged (% total feed) | Removal of Constituent Material (% feed) | Amount Dicharged (% total feed) | Removal of Constituent Material (% feed) | Amount Dicharged (% total feed) | Removed Constituent Material (% feed) | Amount Discharged (% total feed) |
| Top | 3 | 60 | 22 | 24 | — | — | 25 |
| Middle | 2 | 40 | 47 | 52 | — | — | 49 |
| Bottom | — | — | 21 | 24 | 5 | 100 | 26 |
| TOTAL | 5 | 100 | 90 | 100 | 5 | 100 | 100 |

My apparatus and process have been described in particular in the segregation and separation of office-paper-waste material as the mixed density waste material. However, it is recognized and forms a part of my invention that my apparatus and process may be used to segregate and separate other materials of uniform particle size, but containing particles of varying density, such as shredded corn husk or other similar solid natural material, fibrous material, trim waste from slitting and trimming operations containing, for example, paper, plastic, metal foil, paper-board, etc. The particle size of the material segregated may vary, so long as it is essentially uniform. More rapid and better segregation is obtained as the particle size becomes smaller; for example, generally under 2 inches or particularly ½ inch in dimension.

What I claim is:

1. A process for the segregation and separation of mixed office-paper-waste material, which process comprises:

(a) shredding the waste material into waste material of substantially uniform size;

(b) introducing the shredded waste material into a vertically disposed fractionating column;

(c) passing high-volume, low-pressure air upwardly through the column to form a fluidized bed within the column of the shredded waste material, the bed containing at least one discrete segregated layer of the segregated shredded waste material;

(d) removing the segregated waste material from the discrete layer by flowing high-pressure low-volume air to cause lateral flow of the segregated waste material across the discrete layer to a discharge outlet in the column; and (e) recovering the removed segregated waste material.

2. The process of claim 1 which includes shredding the waste material into a uniform size and dimension of ¼ to 2 inches in dimension.

3. The process of claim 1 wherein the office-paper-waste material comprises about 0 to 15% by weight of contaminants, 0 to 15% by weight of coffee cups and heavy waste paper, and the remainder waste writing and newspaper material.

4. The process of claim 1 wherein the high-volume, low-pressure air comprises about 30 to 60 cfm per pound of waste material at a pressure of about 5 to 50 psig.

5. The process of claim 1 which includes introducing the shredded waste material into the lower portion of the fractionating column, and removing a heavy fraction of the waste material from the bottom of the column.

6. The process of claim 1 wherein the top discrete layer comprises contaminant material and the lower layer comprises writing paper and newsprint.

7. The process of claim 1 wherein the recovered waste material is segregated and separated by repeating the steps of claim 1.

8. The process of claim 1 which includes recovering the segregated waste material by passing the removed mixture into an air-solid cyclone separator, and recycling the air from the cyclone for use in the column.

9. The process of claim 1 which includes removing the segregated waste material from the discrete layer by an eductor means in the discharge outlet to move the waste material into the discharge outlet.

10. A process for the segregation and separation of a medium fraction composed of writing paper and newsprint-type paper from mixed office-paper waste containing a light contaminant fraction and a heavy paperboard fraction, which process comprises:

(a) shredding the waste material into waste material of a substantially uniform size and dimension of ¼ to 2 inches in dimension;

(b) introducing the shredded waste material into a vertically disposed fractionating column;

(c) passing high-volume, low-pressure air upwardly through the column to form a fluidized bed within the column of the shredded waste material, the bed containing at least one discrete segregated layer of the segregated shredded waste material;

(d) removing the segregated waste material from the discrete layer by flowing high-pressure low-volume air to cause lateral flow of the segregated waste material across the discrete layer to a discharge outlet in the column; and (e) a recovering the removed segregated waste material.

* * * * *